United States Patent [19]

Garrett

[11] 4,281,724

[45] Aug. 4, 1981

[54] DRILLING HEAD

[75] Inventor: William R. Garrett, Conroe, Tex.

[73] Assignee: Smith International, Inc., Newport Beach, Calif.

[21] Appl. No.: 69,323

[22] Filed: Aug. 24, 1979

[51] Int. Cl.[3] ..... E21B 3/04

[52] U.S. Cl. ..... 175/195; 166/84; 277/31; 308/194; 175/214

[58] Field of Search ..... 175/214, 210, 195; 166/84, 82; 277/31; 308/194, 216, 208

[56] References Cited

U.S. PATENT DOCUMENTS

| | | | |
|---|---|---|---|
| 2,036,537 | 4/1936 | Otis | 277/31 |
| 2,129,433 | 9/1938 | MacClatchie | 277/31 |
| 2,846,247 | 8/1958 | Davis | 277/31 X |
| 3,128,614 | 4/1964 | Auer | 166/84 |
| 3,361,500 | 1/1968 | Pöhle | 308/216 |
| 3,724,862 | 4/1976 | Biffle | 277/31 |
| 3,977,740 | 8/1970 | Struttmann | 308/194 |
| 4,065,192 | 12/1977 | Sague | 308/216 |
| 4,089,570 | 5/1978 | Makfeld | 308/194 |
| 4,154,448 | 5/1979 | Biffle | 277/31 |
| 4,157,186 | 6/1979 | Murray | 277/31 |

*Primary Examiner*—William F. Pate, III
*Attorney, Agent, or Firm*—Murray Robinson; Ned L. Conley; David Alan Rose

[57] ABSTRACT

A drilling head includes a tubular body having removable means for sealing the body to a kelly or other drive tube, a drive bushing releasably mounted in the sealing means to turn the sealing means with the drive tube, the sealing means including a seal tube having a rotating seal means for sealing with the body and a non-rotating seal means for sealing with the drive tube, both seal means being releasably held to the seal tube by common retainer means, such sealing means being rotatably mounted on the body on removable outboard monostratum double acting anti-friction thrust bearing means at the top of the body, the outer bearing race being held between annular flanges, one flange being integral with the body and the other releasably connected to the body, and the inner bearing race being held between annular plates releasably connected to the seal tube, the body having a side outlet and flange connection for the drilling fluid return line substantially flush with the body.

50 Claims, 14 Drawing Figures

Fig. 3
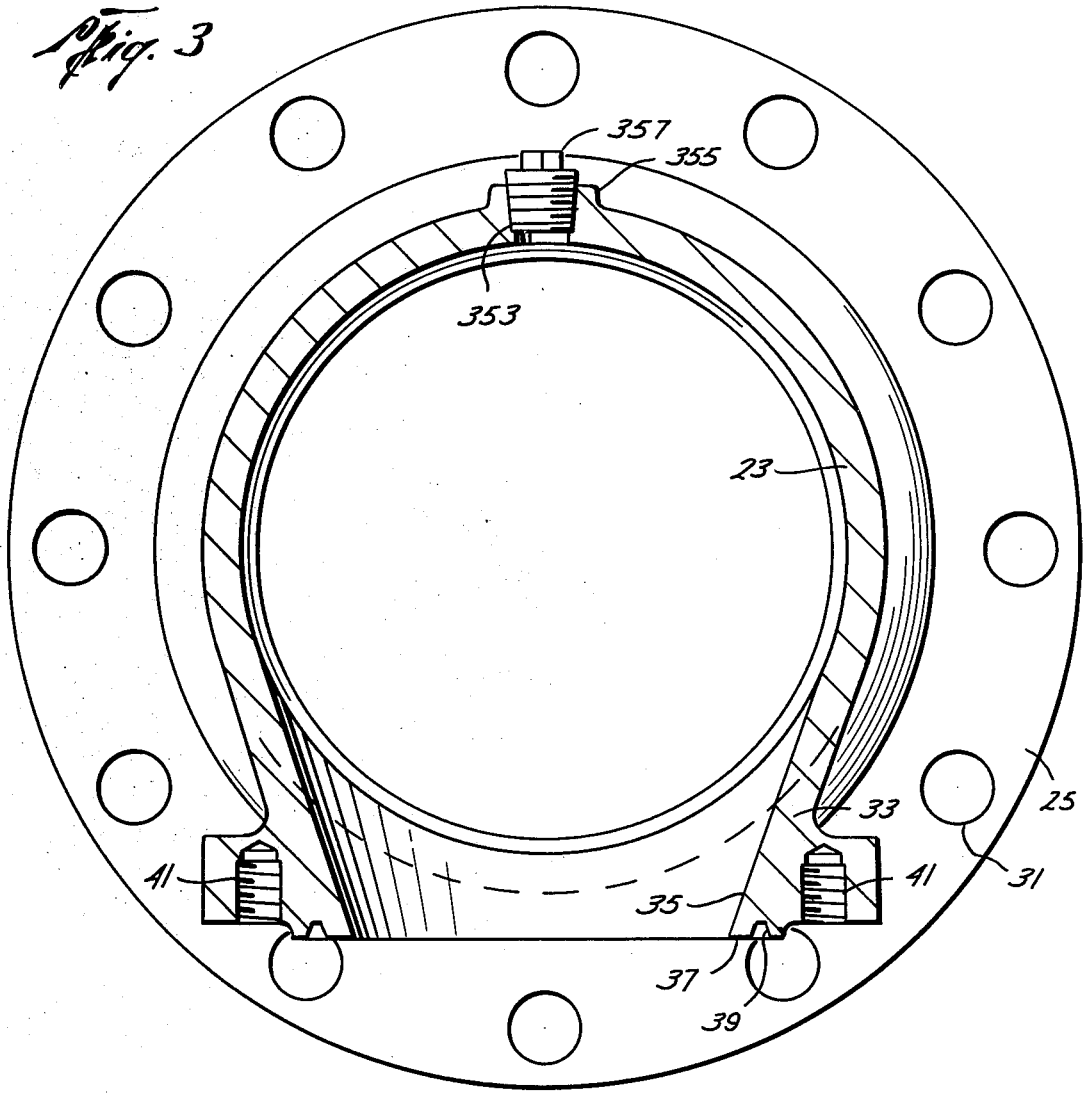
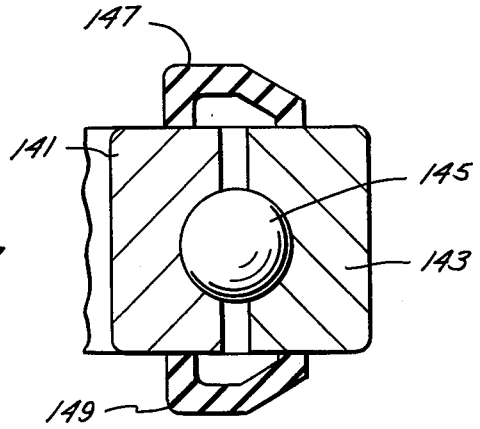
Fig. 5

Fig. 5A
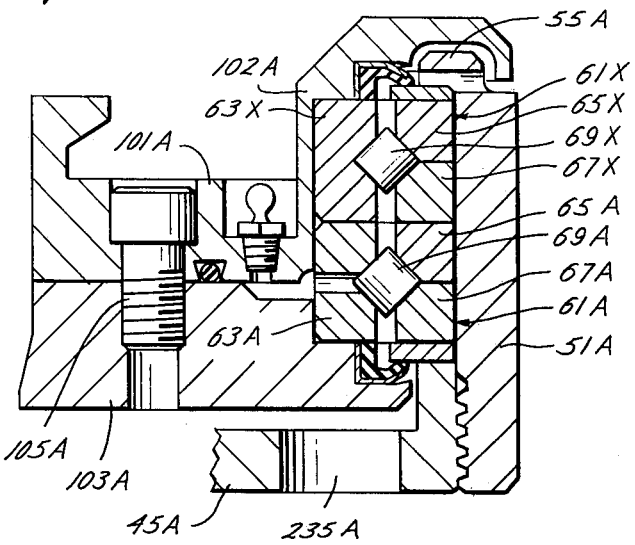
Fig. 5B
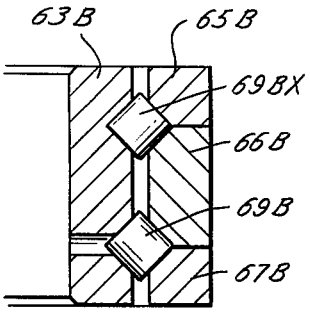
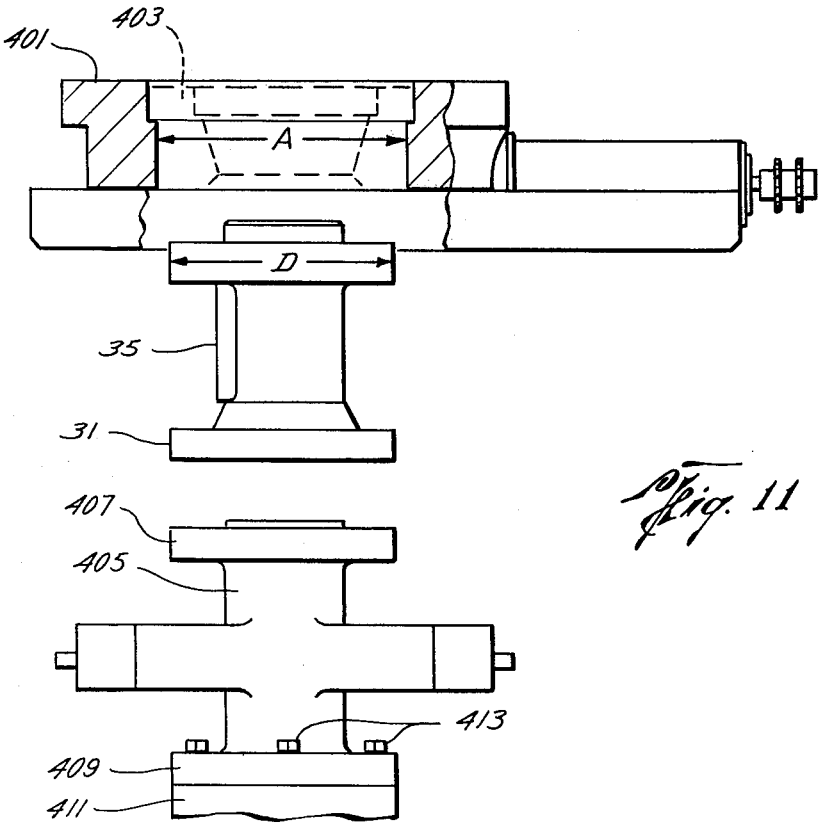
Fig. 11

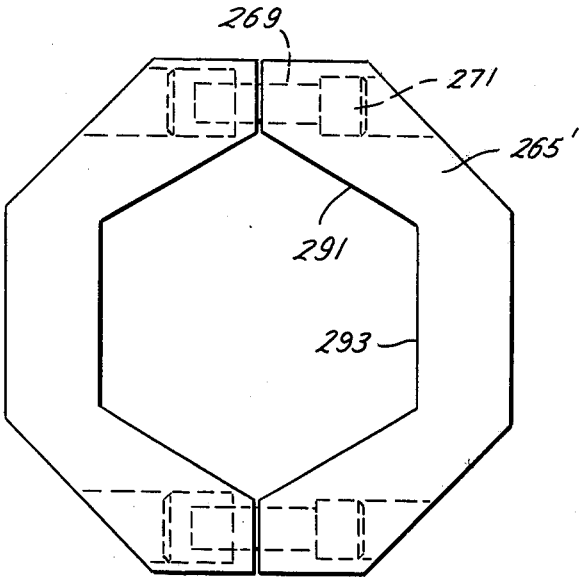
Fig. 7
Fig. 8
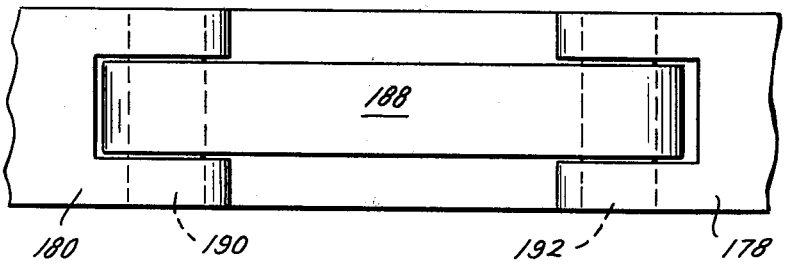
Fig. 9
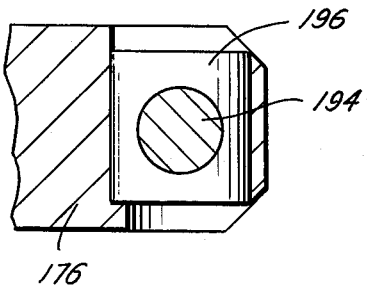
Fig. 10
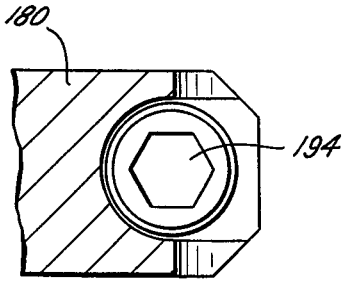

DRILLING HEAD

CROSS REFERENCES TO RELATED APPLICATIONS

The present application discloses a rotary drilling head. Another form of rotary drilling head is shown in three United States of America patent applications assigned to the same assignee as the present application, as follows:

Ser. No. 69,341 filed 8-24-79 by William R. Garrett entitled "Drilling Head",

Ser. No. 69,360 filed 8-24-79 by William R. Garrett et al entitled "Drilling Head", Ser. No. 69,324 filed 8-24-79 by David E. Young entitled "Drilling Head".

BACKGROUND OF THE INVENTION

This invention pertains to earth boring apparatus and more particularly to a rotary drilling head.

In conventional drilling by the rotary method the drill bit cuttings and other detritus are returned to the surface by the drilling fluid which flows back up the annulus around the drill string from the bottom of the hole. At the surface the fluid flows laterally out of the side of a bell nipple or open topped tee which surmounts the stack of drilling equipment, e.g. well head, master valve, and blowout preventers at the top of the well casing. In some cases it is desirable to provide a seal between the upper end of the drilling stack and the rotating drill string extending therethrough. To effect such a seal, the bell nipple at the top of the stack is replaced by apparatus known variously as a drilling head, rotary drilling head, rotary blowout preventer, pressure drilling head, or diverter. Hereinafter such apparatus will be called a drilling head.

A drilling head may be employed with advantage in a variety of circumstances. For example, in gas drilling the drilling fluid may be natural gas, air, or other gas. A drilling head is needed for gas drilling fluid because the returning gas would otherwise tend to flow up toward the bottom of the rotary table and blow detritus onto the workmen on the rig floor whenever the master bushing or kelly bushing was removed from the rotary table.

In reverse circulation drilling, a drilling head is required in order that the annulus can be pressurized sufficiently to cause the drilling fluid (liquid or gas) to move down the annulus and back up the drill string.

In dual conduit drilling, a drilling head is desirable to seal the annulus to prevent drilling fluid from flowing up and out of the annulus.

In the case of geothermal drilling, a drilling head is desirable since the well bore will usually pass through many steam bearing formations. The steam in the drill string expands as it reaches the lower hydrostatic pressures in the top of the annulus and may emerge with the drilling fluid at high velocity.

Except for the seal, a drilling head is similar to a bell nipple in that it includes a tubular body having a side outlet and having a flange or other means at its bottom to support it on the blowout preventer or other drilling stack member and make a stationary seal therewith. In addition to all of the foregoing, a drilling head includes means to seal between the body of the head and the kelly or top joint forming the drive tube of the drill string.

Since the drive tube is normally rotating when the drilling head is in use, means to seal between a drilling head and drill string is quite different from the usual stationary packoff employed at the upper end of a tubing or casing head to seal between such production well head and a production string. A further distinction arises from the fact that a kelly is of non-circular external cross-section, as distinct from the circular outer periphery of tubing or casing pipe. Even, in the case where a power swivel is employed to rotate the drill string and the drive tube is a top joint of the drill string, the outer periphery of the top joint, though generally circular in cross-section, is apt to be rough, as distinct from a polished joint which may sometimes be employed at the upper end of a production string.

The head to string seal means of a drilling head is also to be distinguished from the seal means employed in a blowout preventer, for even in a drilling blowout preventer the seal means usually closes about a kelly or other drive tube that is stationary. However, a preventer must also close about a non-circular outer periphery member such as a kelly, or about a top joint which may be rough. It is perhaps for this reason that a drilling head is sometimes called a rotating blowout preventer.

Because of the problem of sealing with a rotating irregularly shaped drive tube, the head to string seal is divided into two parts. This is accomplished by dividing the drilling head itself into two parts, rotor and stator, the stator being a well head including a tubular body with a bottom flange and side outlet. The rotor is provided with means to make a non-rotating seal with the drive tube (kelly or top joint) and there is provided a rotating seal between circular cross-section surfaces of the rotor and stator. Since the rotor seals with both the drill string and the well head body forming the stator, it may be called a seal tube. The means to seal between the seal tube and well head body may be called a head seal. The means to seal between the seal tube and drill string may be called a string seal.

The string seal may be a large tubular mass of elastomeric material having an inner configuration similar to but smaller than that of the kelly with which it is to seal, i.e., a square or hexagonal or other interior configuration according to whether the kelly has a square or hexagonal or other configuration. Alternatively, the string seal may have a cross-section whose inner periphery is circular with a diameter smaller than that of the minimum transverse dimension of the drive tube (kelly or top joint) and soft enough to form a seal about the drive tube when the latter extends therethrough. The string seal must also have sufficient elastic deformation to allow it to stretch over tool joints or other drill string couplings when the drill string is elevated and the kelly or top joint is pulled out of the string seal, as when adding a length of pipe to the drill string.

Since the string seal fits tightly about the drive tube, the friction therebetween or the engagement of the complementary non-circular cross-sections thereof will cause the seal tube to be rotated with the drill string drive tube and there will be no relative rotational sliding therebetween, although there will be slow relative axial motion as drilling progresses and the drill string lowers into the well bore. To insure that there is no relative rotation between the seal tube and drive tube when the latter is a kelly, a metal drive bushing may be employed between the kelly and seal tube. The drive bushing is a tube having non-circular cross-section inner and outer peripheries, the inner periphery being correlative to the kelly and the outer periphery being correlative to an opening in the seal tube. The drive bushing is made in two parts, being divided axially, so that it can be placed about the kelly, and then bolted together. The drive bushing will be below the usual kelly bushing employed to engage the kelly with the rotary table. While the drive bushing is sometimes called a kelly bushing, such nomenclature creates a confusion with the regular kelly bushing for the rotary table; therefore the term drive bushing is employed hereinafter.

From the foregoing it will be seen that the rotor is a two part member including a seal tube and a drive bushing. Such construction is shown for example in U.S. Pat. Nos.:

2,243,439—Pranger (1941)
2,303,090—Pranger (1942)

The drive bushing will not pass over the connector at the lower end of the kelly. When it is necessary to elevate the kelly out of the drilling head, as when adding a joint of drill pipe or when removing the drill string from the well bore to change the drill bit, the drive bushing lifts out of the opening in the seal tube in which it is normally received. The kelly connector then passes up through the string seal and rotary table. If pipe is being pulled to change the bit, the string seal will also pass the tool joints connecting adjacent lengths of pipe.

However, the string seal will not pass drill string members of well bore diameter, such as reamers, stabilizers and drill bits. When such a member is encountered, or when periodically during the life of a drilling head it is necessary to replace the string seal and/or the head seal, the entire rotor may be lifted out of the stator, preferably leaving behind the anti-friction bearings that support the rotor in the stator. Such construction is shown in U.S. Pat. Nos.:

2,222,082—Leman et al (1940)
3,023,012—Wilde (1962).

The removability of the rotor also makes it possible to remove the string seal at the beginning of a trip, if desired, thereby to avoid passing tool joints through the string seal and the consequent wear and tear.

Other patents showing both of the foregoing constructions are U.S. Pat. Nos.:

2,401,960—Pranger (1946)
3,128,614—Auer (1964).

In the Pranger and the Auer constructions, the bearing means includes upper and lower axially separated cone or roller thrust bearings, to take both upward thrust due to annulus pressure and downward thrust due to weight of the rotor and frictional loads transferred from the kelly. With this arrangement, there apparently is insufficient space below the bearings to provide a side outlet connection flange inboard of the bearing, without making the drilling head unduly high. Pranger provides no side outlet at all, and Auer provides a protuberant side outlet. With a protuberant side outlet, the drilling head may be too large to pass through the opening in a rotary table that is left after the master bushing of such table has been removed, making it necessary to install the drilling head by moving it in laterally underneath the rotary table, working under the drill rig floor.

It is one object of the invention to overcome the foregoing difficulty and provide a drilling head incorporating all the desirable features such as a removable drive bushing, removable rotor, thrust bearing means for taking both upward and downward thrust, string seal and head seal means, and side outlet with connection means for making connection with a pipe flange, which will pass through the master bushing opening of a standard rotary drilling head. For standards one may refer to page 33 of:

APT Spec 7
Thirtieth Edition
April 1975 an API Specification for Rotary Drilling Equipment, issued by the American Petroleum Institute, Division of Production, Dallas, Texas.

Other objects and advantages of the invention will appear from the following description thereof.

SUMMARY OF THE INVENTION

According to the invention a drilling head is provided at its upper end with an outboard mono-stratum double acting thrust bearing, such as a crossed roller bearing, and the tubular body of the head is provided with a side outlet having a flange connection means substantially flush with the outer periphery of the body and inboard of the bearing, the construction being adapted to be installed by passing through the master bushing opening of a standard rotary table, i.e. with the master bushing removed. While a crossed roller bearing enables fairly heavy thrust loads to be taken in both directions with a single stratum bearing, in cases where the expected thrust loading is only light or where anticipated drilling conditions may be exceptionally dirty, a heavy duty single stratum double acting ball bearing may be employed, since balls tend to squeeze dirt out to the side as distinct from rollers which may pass over the dirt and be worn, overstressed, or broken. By a mono- or single stratum bearing is meant one in which there are two races with all the rotatable members therebetween sweeping through the same annular volume or stratum between the races.

Since the primary purpose of the bearing is to support the rotor with respect to radial loads, the bearing is provided with inner and outer races for the rotatable members, whether thay are rollers or balls.

The outermost single stratum bearing is supported between a wide, outturned, lower flange, integral with the top of the tubular body of the head and a narrow, upper inturned apertured flange forming the top of a screw cap whose internally threaded ring is screwed onto the threaded outer periphery of the lower flange.

The innermost race of the bearing is supported by a pair of annular plates screwed together with the race at their outer peripheries, the plates overlying the inner part of the lower flange. The upper plate is releasably secured to the upper end of the seal tube, so that the seal tube can be easily removed, along with the drive bushing that is supported therein but separately freely, removable therefrom.

Means is provided to seal and lubricate the bearing.

The seal tube is provided with an elastomer string seal element having a metal collar at its upper end for releasable securement to the metal body of the seal tube. Flexible metal support fingers extend into the elastomer from the collar.

There is a head seal between the seal tube and the body of the head. The head body is provided with a socket having a replaceable smooth metal liner, and the seal tube is provided at its lower end with a tubular pin having packing material replaceably retained thereon. The pin packing fits into and makes a rotatable seal with the socket liner. A common retainer holds both the pin packing and the string seal element to the seal tube. Means is provided to lubricate the head seal.

BRIEF DESCRIPTION OF THE DRAWINGS

For a detailed description of preferred embodiments of the invention, reference will now be made to the accompanying drawings wherein:

FIG. 3 is a horizontal section through the drilling head, taken at plane 3—3 indicated on FIG. 2;

FIGS. 5, 5A and 5B are vertical sections through modified forms of the bearing means of the drilling head, FIG. 5A including also a fragmentary section of adjacent parts similar to FIG. 4A;

FIG. 7 is a fragmentary horizontal section through a modified form of drive bushing for the drilling head, adapted to fit about a hexagonal cross-section kelly;

FIG. 8 is a view as indicated at 8—8 in FIG. 6;

FIG. 9 is a fragmentary sectional view taken at plane 9—9 of FIG. 6;

FIG. 10 is a fragmentary elevation viewed from plane 10—10 of FIG. 6; and FIG. 11 is a stage drawing, partly in section and partly in elevation showing the drilling head of FIG. 1 being lowered through a rotary table to position atop a drilling stack.

Figure 1:
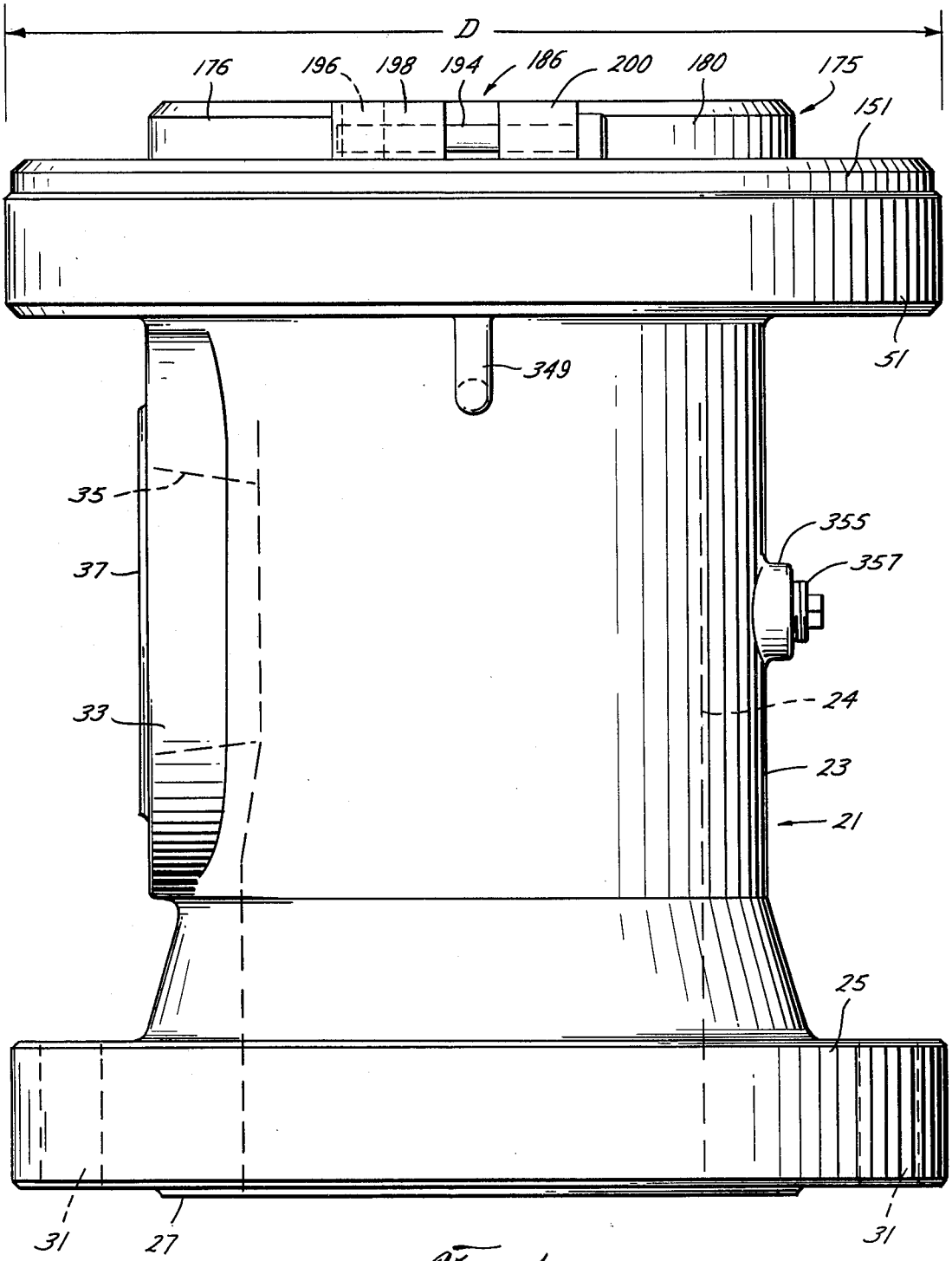
FIG. 1 is a side view of a drilling head embodying the invention.

The drawings are to scale. Dimension D in FIG. 1 represents 25 inches. The Patent Office Conventions for materials have been employed, from which it will be seen that the drilling head is made of metal, except for certain seal elements and lubricants. The metal preferably is rigid and elastic, such as steel. The seal elements are elastomeric oil resistant material such a Neoprene, common Nitrile, common Urethane, or other synthetic rubber.

DESCRIPTION OF PREFERRED EMBODIMENTS

Figure 2:
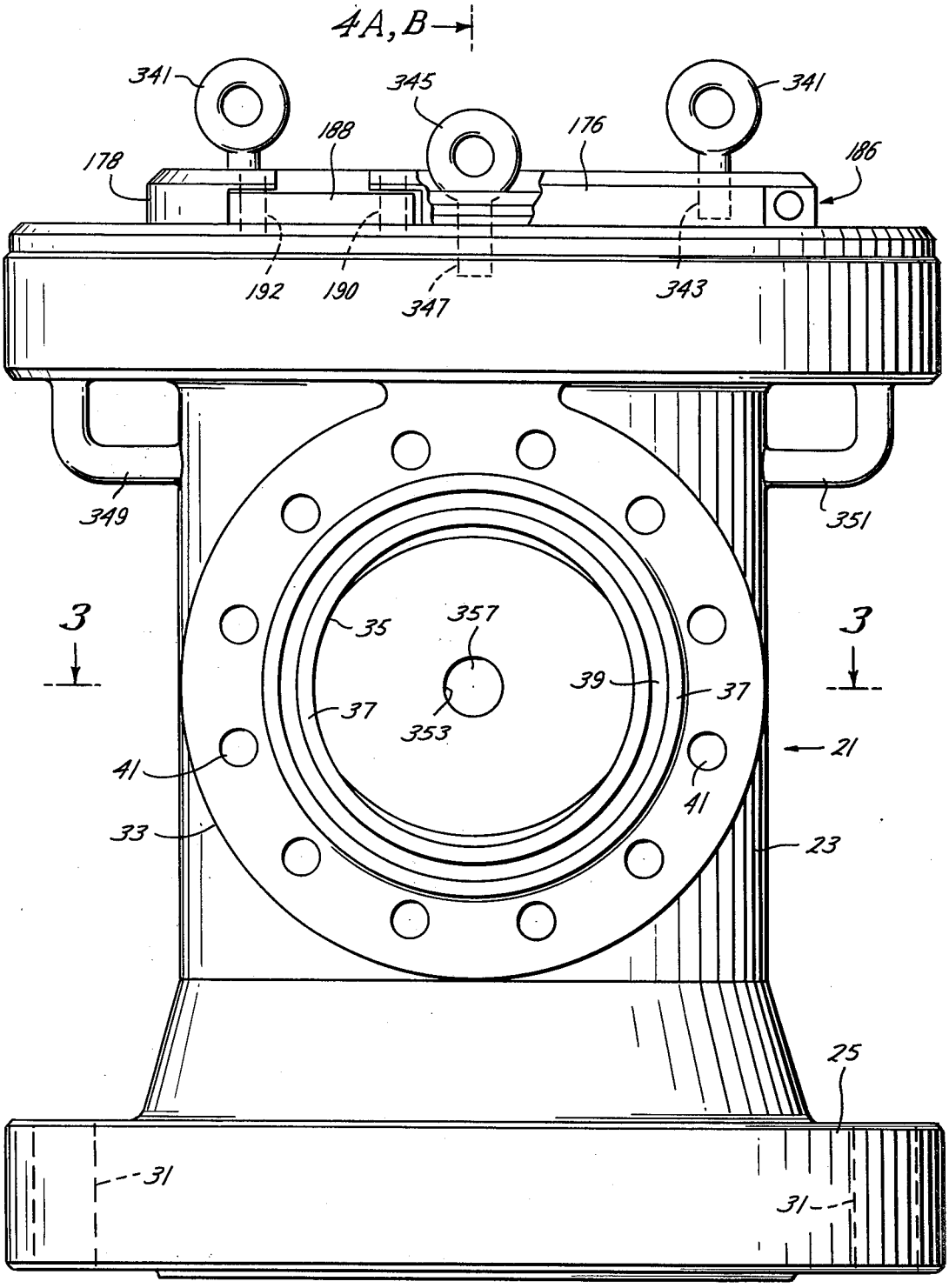
FIG. 2 is a front view of the drilling head shown in FIG. 1, with lifting eye means installed, part of the collar and screw cap being broken away in order to show some of the eye means more fully.

Referring now to FIGS. 1 and 2, there is shown a drilling head 21 comprising a tubular body or head 23 having a generally cylindrical vertical passage 24. Body 23 has lower flange 25 adapted for making a fluid tight connection with a corresponding flange at the top of another drilling stack member, such as a blowout preventer. The lower part of the flange is provided with a planar face 27 having an annular groove 29 (see FIG. 4B) therein adapted to receive a steel ring gasket for sealing flange 25 to the flange below it. Holes 31, azimuthally spaced apart about the axis of the head, are adapted to receive bolts or studs, not shown, for securing flange 25 to the flange below it and drawing the flanges together against the steel ring gasket.

Referring now also to FIG. 3, in the side of tubular body 23 is a thickened portion or annular boss 33 through which extends side outlet port 35. Near the inner periphery of the boss is an annular planar face 37. In face 37 is an annular groove 39 adapted to receive a steel ring gasket for making a sealed connection with a corresponding flange on the end of a drilling fluid return pipe. A circle of azimuthally spaced threaded holes 41 are provided to receive bolts or studs for securing the drilling fluid return line flange to the side of the body 23 over side outlet 35, with a steel ring gasket sealing the flange to planar face 37.

Referring now to FIG. 4, tubular body 23 of the drilling head is provided with outer bearing race support means comprising an upper annular flange 45 integral with body 23. Flange 45 has an integral upstanding outer peripheral lip 46. The outer periphery of the flange is threaded at 47 to receive a screw cap 49. The screw cap includes a ring 51 having an internal thread 53. The top of the cap is apertured, being formed by an inturned annular flange 55 integral with the ring.

Closely fitted inside ring 51 in the annular groove formed therewith between flanges 45 and 55 is bearing means 61. The bearing means comprises an inner race 63 and a horizontally split outer race including upper and lower rings 65, 67. A circle of rotatable members, i.e. rollers 69, is disposed between the races with their axes 71, 73 alternating in direction. Each race is provided with upper and lower conical tracks 75, 77, and 79, 81. Line elements of tracks 75, 79 are set at right angles to line elements of tracks 77, 81. Rollers with axes 71 transmit downward thrust from the upper track of the inner race to lower track of the outer race. Rollers with axes 73 transmit upward thrust from the lower track of the inner race to the upper track of the outer race. All of the rollers transmit radial thrust between the races in both directions, inward and outward. Bending loads are supported by transmitting axial load in one direction on one side of the bearing and axial load in the opposite direction on the other side of the bearing.

Means is provided to seal between the inner and outer races comprising upper and lower annular elastomer rings 85, 87, and upper and lower metal seal washers 89, 91. The inner planar faces of the seal washers, that is, the ones adjacent the outer bearing race rings make face seals with the outer planar faces thereof, being clamped in engagement therewith between flange 55 of the screw cap and lip 46 of the upper flange of the well head. The outer planar faces of the seal washers make sliding, rotating contact with annular lips formed at the outer peripheries of seal rings 85, 87, forming rotating seals therewith. The inner faces of their seal rings at the inner peripheries make stationary contact with the adjacent outer planar faces of the inner race of the bearing means, forming stationary seals therewith.

Inner bearing race support means comprises upper and lower annular plates 101, 103, overlying upper flange 45 of the body of the head. These plates are releasably secured together by a circle of azimuthally spaced part cap screws 105 passing through holes 107 in the upper plate and screwed into threaded holes 109 in the lower plate. The outer peripheries of the plates have annular rabbets 111, 113 forming an annular groove receiving inner bearing race 63 which is clamped therebetween. Outer rabbets 115, 117 receive seal rings 85, 87, clamping them into sealing engagement with the inner race.

Upper plate 101 has an annular groove 119 in its lower face. The groove is of trapezoidal cross-section to retain O-ring 121 pressed through the mouth of the groove into the larger interior part of the groove. The O-rings form an annular seal between the two plates.

Outwardly of such annular seal, lower plate 103 is provided with an annular relieved area 123 forming a lubricant reservoir. The reservoir is filled with grease through one or more inwardly opening check valve fittings 125 screwed into taper threaded holes 127 extending through the top plate into sockets 129 therein. Holes 127 communicate with reservoir 123 which in turn communicates with port means 131 extending radially through inner bearing race 63 to the volume between the races. The lubricant is retained in such volume by the bearing race seal means previously described, including elastomer seal rings 85, 87 and metal seal washers 89, 91. Such seal means also keeps dirt out of the bearing means.

Seal washers 89, 91 provide sliding seal surfaces which may be more smoothly finished than the faces of the outer bearing race. Also, they provide seal surfaces which can be readily replaced. However, as shown in FIG. 5, such seal washers could be omitted and the elastomer seal rings could seal directly with the outer bearing race. Another alternative construction which could be used for the bearing means is the employment of ball bearings in place of roller bearings. Ball bearings can take a certain amount of axial thrust in both directions in addition to inward and outward radial thrust, especially if the bearing races have toroidal tracks to make contact with the balls along semi-circular lines instead of merely at points. For convenience both of these alternatives are disclosed in FIG. 5, although they each may be separately employed.

Referring to FIG. 5 there is shown bearing means comprising inner and outer races 141, 143. A plurality of rotatable members, i.e. balls such as 145, are disposed between the races, having been introduced through a port in the outer race which was subsequently closed with a plug (port and plug not shown). Such a ball bearing could also be made by splitting one of the races, e.g. similarly to the FIG. 4A construction. Upper and lower elastomer seal rings 147, 149 seal between the races. The FIG. 5 assembly can be substituted for the bearing means and race seals of the FIG. 4 construction e.g. by providing more height to lip 46 on the upper flange of the head body and less height to flange 55 on screw cap.

Figure 4A:
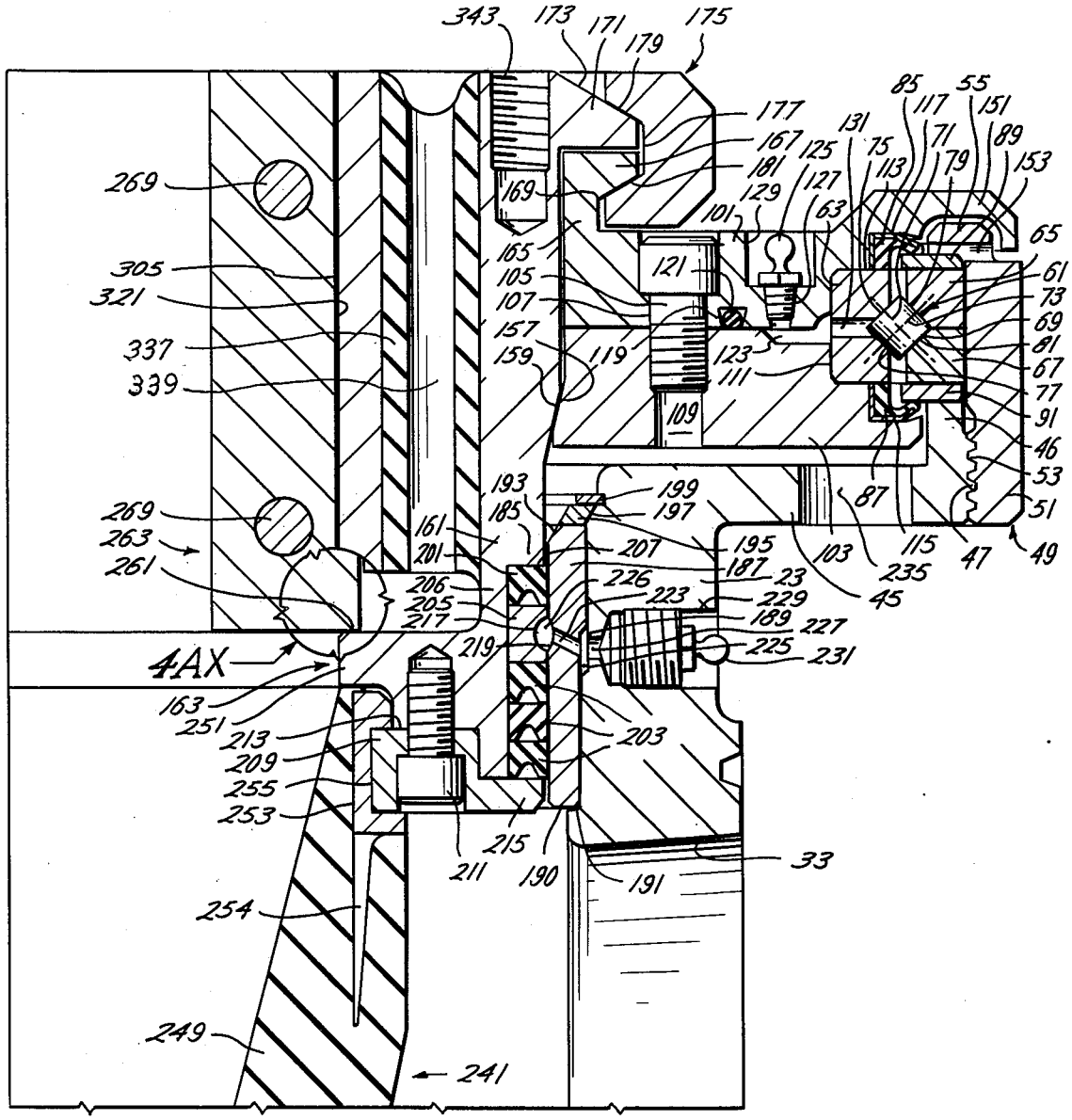
FIGS. 4A and 4B, sometimes hereinafter referred to together as FIG. 4, are upper and lower fragmentary vertical sections taken on a plane through the axis of the drilling head.
Figure 4B:
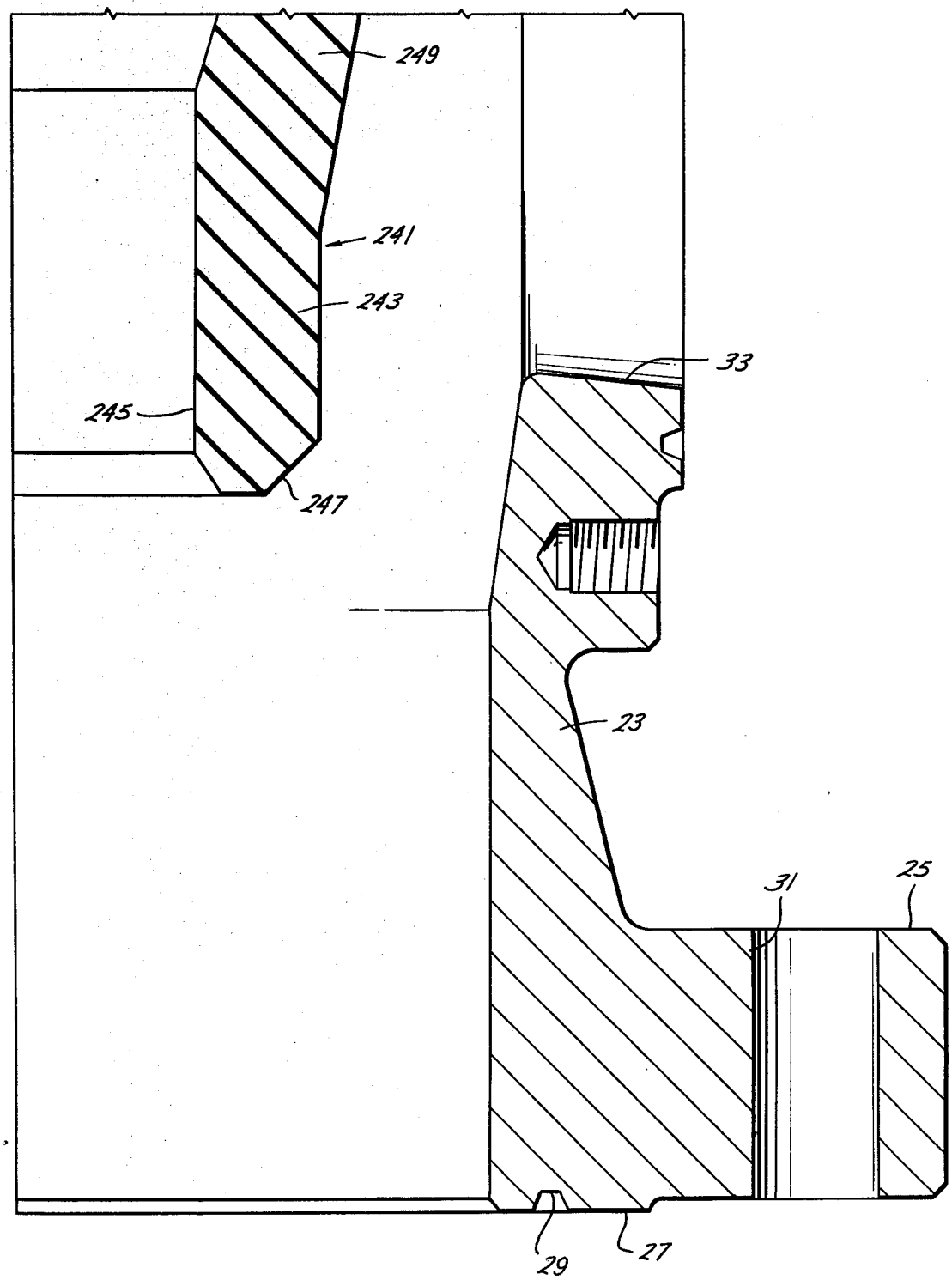

In FIG. 4A was shown the use of cross roller bearings for normal double thrust loads, e.g. with two-thirds of the rollers disposed to take down thrust. In FIG. 5 was shown the use of toroidal track ball bearings for light thrust loads. In case of extremely heavy thrust loads, plural stratum bearing means may be required. However, in accordance with the invention the races of the several strata should be placed immediately adjacent to each other, i.e. contiguous. FIGS. 5A and 5B illustrate such arrangements.

Referring to FIG. 5A, the drilling head construction is mostly the same as in FIG. 4A, so corresponding parts are given like numbers except for the addition of a letter "A" or "X" in FIG. 5A. This will avoid repeating the same description; only the differences need be mentioned. In the FIG. 5A construction upper plate 101A has an upstanding outer peripheral flange 102A whereby rabbet 113A at the lower side of the plate is deep enough to receive the entire inner race 63X of an upper cross roller bearing 61X as well as part of the inner race 63A of a lower cross roller bearing 61A, the two inner races being immediately adjacent. Ring 51A extends upwardly a greater height to flange 55A in order to accommodate the two outer split bearing races 65A, 67A and 65X, 67X, the races being immediately adjacent. No seal washers corresponding to 89, 91 of the FIG. 4A construction are employed in the FIG. 5A construction. Bearing rollers 69A and 69X may be set with their axes as shown so that upper bearing means 61X takes down thrust and lower bearing means 61A takes up thrust. However, if desired, the rollers of lower bearing means 61A could be set to take up thrust and the rollers of the upper bearing means 61X could be set to take down thrust, or the rollers of either or both of the upper and lower bearing means could be set with their axes some in one direction and some in the other as in the FIG. 4A embodiment. In both embodiments, the ratio of rollers set to take thrust in one direction to those set to take thrust in the other direction in each bearing means can be set as desired. For example, in the FIG. 4A embodiment the rollers could be disposed so that two rollers set to take up thrust are disposed for each one roller set to take down thrust, it being anticipated that up thrust may be much greater than down thrust, the roller pattern being 2-1-2-1-2-1, etc. The roller axis distribution is symmetrical about the bearing means axis in all cases. An another example, in the FIG. 5A embodiment the roller axis distribution might be 2-1-2-1-2-1 in that the upper bearing means 161A so that twice as many rollers are set to take up thrust as down thrust, and all of the rollers in the lower bearing means could be set to take up thrust.

Referring now to FIG. 5B, instead of employing separate though immediately adjacent races for the upper and lower bearing means, one integral inner race 63B may be employed, and one outer race split into three parts 65B, 66, 67B may be employed, carrying two sets of rollers 69B, 69BX.

Whether the bearing means be a single monostratum bearing or two monostratum bearings with their races immediately adjacent, i.e. touching, or with their races integral, it is characteristic of the invention that rigid antifriction combination radial and double acting thrust bearing means be concentrated and in one place rather than axially dispersed, whereby it can be lubricated with a single lubrication system and located high enough on the low profile drilling head body to leave room for a side outlet surrounded by flush means for making connection with a pipe flange. By rigid is meant having a low percentage of deformation under nondestructive loading, typical of rolling elements (e.g. balls and rollers and cones) and races made of steel, as distinct from elastomeric materials. In other words, rigid refers to materials having a high modulus of elasticity, i.e. at least 100,000 psi, and a thickness in all unsupported load taking directions to prevent deformation of more than 10% of thickness at yield. Only if the bearing means is rigid can sufficient resistant to bending moments in the drill string be furnished by a concentrated (single location) bearing means. By anti-friction bearing means is meant bearing means including rolling elements such as balls, cones or rollers rolling in between the relatively rotating members. By double acting is meant capable of taking axial thrust in both directions, e.g. up and down. By combination is meant capable of taking both radial and axial loading. By a concentrated bearing means is meant a single monostratum bearing or plural monostratum bearings with zero spacing between stacked races, i.e. continguous (immediately adjacent) or integral.

The bearing means shown in FIGS. 4A, 5, 5A and 5B do not include roller cages. However, cages may be employed if desired, e.g. for higher speeds of rotation. The illustrated cross roller bearing means have split outer races to enable the roller elements to be positioned between the races; however, the inner races could be split instead, or the rollers can be positioned through holes in the races.

Referring once more to FIG. 4, upper plate 101 has an annular rim 151 overlying flange 55 to guard the bearing means against entrance of dirt between flange 55 and plate 101 and to protect seal ring 85. Flange 55 is provided with a plurality, e.g. four, azimuthally spaced apart radial drain holes 153 to prevent accumulation of dirty grease and dirt under the rim.

Lower place 103 is provided with an upwardly flaring conical seat 157 receiving the correlatively tapered conical shoulder 159 on the outer periphery of tubular body 161 of seal tube 163. Upper plate 101 has an upstanding neck 165 about its inner periphery, the neck having an annular outturned radial flange 167 at its upper end. Flange 167 has a conically tapered, flaring upwardly flaring, lower surface 169. Seal tube body 161 has an annular outturned radial flange 171 at its upper end. Flange 171 has conically tapered, downwardly coverging upper surface 173. A double hinged collar 175 having an internal groove 177 with side walls 179, 181 tapered correlatively to flange surfaces 169, 173, wedgingly engages the latter surfaces and releasably fastens the seal tube to the upper plate.

Figure 6:
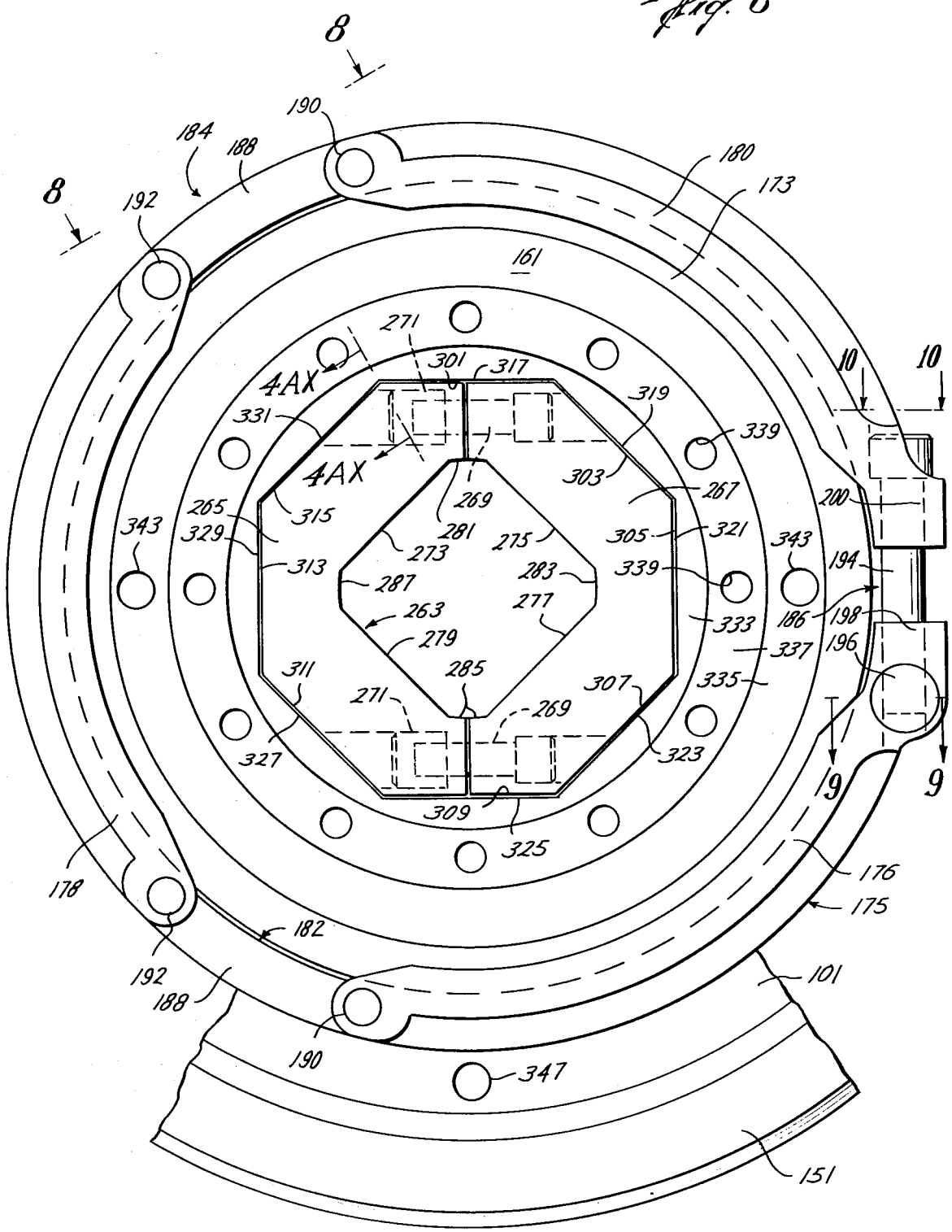
FIG. 6 is a top of the drilling head shown in FIGS. 1–4.

Referring now to FIGS. 1, 2 and 6, collar 175 comprises three arcuate sections 176, 178, 180. The three sections are connected together by two double pintle hinges 182, 184 and pivoted bolt lock 186. Each double pintle hinge (see also FIG. 8), includes a link 188, pivotally connected at its ends by pintles, such as 190, 192 to the adjacent sections of the collar. The bolt lock (see also FIGS. 9 and 10), includes a bolt 194 screwed into nut 196 (see esp. FIG. 1) which is rotatably mounted near 198 in section 176 of the collar. Bolt 194 extends through an opening in ear 200 on section 180 of the collar. When the bolt is screwed into nut 196, the sections of the collar are drawn tightly together about the flanges 167, 171. Since nut 196 is pivoted, its threads can remain coaxial with those of the bolt despite changing position of ears 198, 200.

The lower part of seal tube 161, below shoulder 159, provides a pin 185 which is telescopically rotatably received in a socket in the body of the head. The socket is provided by liner sleeve 187 which makes an interference fit in double stepped bore 189 in body 23, the lower end 190 of the liner resting on the lower step or shoulder 191 of such body bore. End 190 overhangs shoulder 191 to facilitate removal and replacement of the liner. The upper end of line 187 is provided with a guide bevel 193. On top of liner 187 is an internally bevelled guide ring 195 forming a continuation of the surface of guide bevel 193. The outer periphery of ring 195 is bevelled to provide a seat to rest on tapered shoulder 197 in body 23. A retainer ring 199, such as a Truarc snap ring, above guide ring 195 provides means to retain the guide ring in position and also provides positive retention of the liner.

Head seal means to provide a rotating seal between pin 185 and the head socket formed by liner 187 comprises a portion 200 of reduced diameter at the lower end of the pin. Such portion is adapted to receive elastomeric double lip rings 201, 203 and metal ring 205. The packing rings are positioned with their lips on their lower surfaces to seal against upwardly directed pressure. They are held in position against pin shoulder 207 by diametrally split retainer ring 209 releasably fastened to the lower end of seal tube 161 by a plurality of cap screws such as 211. The retention ring fits in an inner peripheral rabbet 213 in the lower end of tube 161 and has an outer peripheral radial flange 215 which supports the lowermost elastomeric seal ring 203. By removing split ring 209, the seal ring assembly 201, 203, 205 can be removed and replaced in whole or in part.

Metal ring 205 has an external annular groove 217 in its outer periphery opposite an internal annular groove 219 on the inner periphery of liner 187 forming a lubricant distribution channel 226. One or more radial ports 223 connect channel 226 with a similar channel 225 formed between liner 187 and head 23. Channel 225 communicates via port 227 with threaded socket 229 in which is disposed inwardly opening check valve fitting 231. By the foregoing means the rotating tube to head seal is lubricated and a lubricant reservoir is provided.

In case the head seal, i.e. the seal between the seal tube and drilling head body, should leak, the leaking fluid is vented to atmosphere by one or more pressure relief ports 235 in upper flange 45 of the head body, thus keeping the bearing seal means from being exposed to drilling fluid pressure.

String seal means to seal between the seal tube and upper drill string member, e.g. kelly or top joint, whichever is employed as a drive tube, comprises a tube 241 of elastomeric material releasably fastened to the lower end of seal tube body 161. Tube 241 is a fairly soft material, preferably having a durometer hardness on the Shore A scale of between 55 and 95. The lower or sealing portion 243 (FIG. 4B) of elastomeric tube 241 has an inner surface 245 whose diameter is smaller than the smallest outer transverse dimension of the drive tube (kelly or top joint) about which it is to seal. The tube has a sufficiently low elastic modulus that it will seal against the flats of a kelly rather than bridge across the corners of the kelly. The length of sealing portion 243 is sufficient to enable a seal to be formed despite the modest pressure between the inner surface 245 of such portion and the drive tube about which it fits. The lower end of sealing portion 243 is initially bevelled to guide tool joints and other couplings, including the lower end of the kelly or top joint, through the sealing tube when necessary. The lower end of sealing portion 243 is bevelled on its outer periphery at 247 to guide drilling fluid flowing therepast to side outlet 33.

The upper portion 249 of the sealing tube flares outwardly to engage inturned radial flange 251 at the lower end of seal tube 161. A metal collar 253 is set in the outer periphery of the upper portion 249 and bonded thereto. Azimuthally spaced flexible tapered metal fingers 254 integral with collar 253 and extend down into portion 249. Collar 253 has an outer peripheral groove 255 which receives split retainer ring 209. When cap screws 211 are removed and ring 209 is released, string sealing tube 241 can be replaced simultaneously with head sealing rings 201, 203, 205.

Resting on the upper face of circular seal tube flange 251 are the corners, such as 261, of split drive bushing 263. Bushing 263 includes two halves 265, 267 (see also FIG. 6) secured together by a plurality of sets of bolts 269 and nuts 271, disposed two sets on each side, one upper and one lower. Only the upper sets appear in FIG. 6, but both levels show in FIG. 4. The inner periphery of the drive bushing is provided with four flat surfaces 273, 275, 277, 279, placed ninety degrees apart, adapted to engage slidably with a square cross-section kelly. Although the cross section of the inner periphery of the drive bushing is square, the corners are flattened as shown at 281, 283, 285, 287.

FIG. 7 shows a modified form of drive bushing wherein the inner periphery has a hexagonal cross-section adapted to receive and be driven by a hexagonal cross-section kelly instead of a square cross-section kelly for which the FIG. 4 construction is adapted. As with the FIG. 4 construction, the drive bushing is split into two halves along a vertical diametral plane. It will be understood that the construction of the complete drive bushing is the same as that of drive bushing 263 of FIGS. 4 and 6 except that it is provided with six inner flat faces such as 291, 293. The outer peripheral surfaces of the FIG. 7 drive bushing are the same as those of the FIG. 6 construction, both bushings having an outer periphery of octagonal cross-section.

Referring to FIG. 6 once more, the outer periphery of drive bushing 263 has eight vertical flat sides 301, 303, 305, 307, 309, 311, 313, 315, each disposed at forty-five degree angles to the two adjacent sides. The octagonal outer periphery of the drive bushing fits loosely slidably into a correlative octagonal opening in the top of seal tube 161, such opening having eight vertical flat sides 317, 319, 321, 323, 325, 327, 329, 331. By this means the kelly, which rotates the drive bushing, causes the seal tube to rotate in synchronism with the kelly.

Referring now to FIGS. 4 and 6, in order to damp out vibrations of the kelly or other drive tube, which tend to be transmitted to the drilling head, the seal tube is made of two parts, an inner part 333 and an outer part 335, bonded to elastomeric sleeve 337, the sleeve being molded in situ between the two parts. There is thus formed an elastomeric sandwich. Sleeve 337 preferably has a durometer hardness on the Shore A scale of between 55 and 95. The elastomer sandwich will transmit vibrations from kelly to seal tube at a reduced amplitude for most frequencies expected to be encountered.

When it is desired to replace the liner, the screw cap can be loosened with a hydraulic tool and the screw cap removed. Then the rotor can be lifted out and the liner pulled out and replaced with suitable hydraulic tools.

In order to prevent undue internal stresses in the elastomer sleeve, the sleeve is molded with cores to provides holes 339, in a manner similar to that described in U.S. Pat. Nos.:

3,033,011—Garrett 3,099,918—Garrett.

When it is desired to change drive bushings, or to remove the drive bushing for any other reason, it is lifted up out of the seal tube, e.g. with the kelly, and the sets of bolts and nuts 269, 271 disconnected to allow the two halves of the drive bushing to be taken apart.

When it is desired to replace the seal tube seals, lifting eyes 341 (FIG. 2) are screwed into threaded holes 343 (FIGS. 2, 4 and 6) in the upper end of the seal tube. With collar 175 removed, the seal tube can be lifted out of the inner bearing race support plates 101, 103. The seal tube may also be removed in this manner whenever it is desired to remove the entire drill string to change the drill bit, thereby avoiding the need to strip tool joints through the string seal. The same eyes may be used to lower the seal tube back into place.

When it is desired to replace the bearing means 61, screws 105 are removed to allow top plate 101 to be lifted off. Then screw cap 51 can be removed and the bearing removed. If desired, screw eyes can be inserted in the holes from which screws 105 were removed and plate 103 can be lifted out, together with the bearing means or subsequent to removal of the bearing means. In replacing the screw cap a suitable hydraulic tool may be employed to tighten the cap to the desired amount.

Referring once more to FIG. 2, screw eyes 345 (FIG. 2) may be screwed into threaded holes 347 at opposite sides of plate 101 to permit lifting and subsequent placement of the whole head by lowering it through the rotary table. Handles or lifting eyes 349, 351 are provided at opposite sides of the drilling head, formed integral with tubular body 23 thereof, to facilitate handling the head during such an operation. In this regard see FIG. 11, which shows a drilling head 21 being lowered through a rotary table 401 from which the master bushing 403 shown in phantom lines has been removed. The drilling head is directed to land on the top of a drilling stack including blowout preventer 405, and lower drilling head flange 31 is to be bolted to top flange 407 of the preventer, just as lower flange 409 of the preventer is secured fluid tight to flange 411 of the next lower stack member by bolts 413. The head in the present construction has a side outlet so that a separate tee or well head with a side outlet need not be placed under the drilling head. It will be noted that dimension D, the largest transverse dimension in the present construction, is small enough to go through a rotary table master bushing opening of dimension A and that side outlet 35 does not extend beyond dimension D. It is also to be noted that the cap diameter D is equal to the diameter of lower flange 31.

Referring to page 33 of the aforementioned API Spec 7, there are listed nominal rotary table sizes and corresponding dimensions A, dimension A being the smallest diameter of the opening in the rotary table in which is received the master bushing. For any given size rotary table, dimension D of the drilling head will be smaller than dimension A sufficient to allow easy passage of the head through the master bushing opening of the table.

In case it is desired to have access to the interior of the drilling head other than through its top or side outlet, a threaded side port 353 is provided (FIGS. 1 and 2) through a boss 355 in body 23 opposite from side outlet 35. Port 353 is normally closed and sealed by a screw plug 357. Port 353 can be used for example as a fill opening, or for a pressure gage.

While a preferred embodiment of the invention and several modifications have been shown and described, other modifications can be made by one skilled in the art without departing from the spirit of the invention.

I claim:

1. Drilling apparatus comprising:

a stator including a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator, head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said bearing means comprising double acting antifriction axial thrust bearing means concentrated adjacent a single plane transverse to the axis of said tubular body of the stator above said head seal means and string seal means, said pipe connection means and the rest of said apparatus lying within the cylindrical geometrical envelope centered on the axis of said bearing means which envelope lies just outside of the outer periphery of said flange.

2. Apparatus according to claim 1, said pipe connection means comprising annular means about said port on the exterior of the side of the tubular body adapted for making a sealing connection with a pipe flange and threaded sockets in said side wall of the tubular body disposed about said means for making a sealing connection.

3. Apparatus according to claim 1, said bearing means being outboard of said pipe connection means, and vertically aligned with said radial flange.

4. Apparatus according to claim 1, said bearing means comprising a mono-stratum crossed roller bearing.

5. Apparatus according to claim 1, said bearing means comprising a toroidal track ball bearing.

6. Apparatus according to claim 3, said bearing means including inner and outer races with rotatable means therebetween, said bearing support means on the stator comprising a ring and upper and lower flanges connected to the ring and extending inwardly therefrom and forming therewith a seat receiving said outer race of the bearing means, said lower flange being connected to said tubular body and extending therefrom out over said pipe connection means and said radial flange, the connection of said ring to one of said flanges being releasable.

7. Apparatus according to claim 1, said head seal means including a liner sleeve seated on an annular shoulder in said tubular body of said stator and releasably held in place thereon, and packing means about said rotor rotationally slidably engaging said sleeve and making a rotating seal therewith, said packing means being releasably positioned on and turning with said rotor.

8. Apparatus according to claim 7, said head seal means further including port means in said tubular body communicating with an annular passage between said liner and the last said body, said liner having an annular groove on its inner face, and port means in the liner communicating said annular groove in the liner with said annular passage, whereby lubricant can be introduced to said packing means.

9. Apparatus according to claim 8, said packing means including a stack of rings, one of said rings being a metal ring having an annular groove adjacent to said annular groove of the liner, other ones of said rings above and below said metal ring being downwardly facing double lip flexible seal rings.

10. Apparatus according to claim 1, said head seal means including annular seal means disposed about the outer periphery of said rotor against an external shoulder thereabout, said string seal means comprising tubular seal means having an upper portion disposed about the inner periphery of said rotor against an internal shoulder thereof, and said head and string seal means further including retainer ring means releasably secured to the lower end of said rotor holding said annular and tubular seal means to said rotor, said head seal means and string seal means extending axially in opposite directions from said retainer ring, said tubular seal means extending downwardly from said retainer ring means and said head seal means extending upwardly therefrom.

11. Apparatus according to claim 1, said string seal means comprising a tubular elastomeric seal means having a metal ring bonded to the upper end thereof, said ring having an outer peripheral groove thereabout, and a split retention collar disposed in said groove and releasably secured to the lower end of said rotor.

12. Apparatus according to claim 11, said metal ring including an upper annular portion wherein is disposed said groove and a plurality of azimuthally spaced fingers integral with said annular portion extending down from said upper portion into the elastomer of said elastomer seal means and adapted to flex therewith.

13. Drilling apparatus comprising:

a stator including a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion nonrotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator, head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said bearing means comprising double acting anti-friction axial thrust bearing means concentrated adjacent a single plane transverse to the axis of said tubular body of the stator above said head seal means and string seal means, said pipe connection means and the rest of said apparatus lying within the cylindrical geometrical envelope centered on the axis of said bearing means which envelope lies just outside of the outer periphery of said flange, said bearing means including inner and outer races with rotatable means therebetween, said bearing support means on the stator comprising a ring and upper and lower flanges connected to the ring and extending inwardly therefrom and forming therewith a seat receiving said outer race of the bearing means, said lower flange being connected to said tubular body and extending therefrom out over said pipe connection means, the connection of said ring to one of said flanges being releasable, said inner race including separable upper and lower rings, said upper and lower flanges holding said upper and lower rings together.

14. Drilling apparatus comprising:

a stator including a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator, head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said bearing means comprising double acting anti-friction axial thrust bearing means concentrated adjacent a single plane transverse to the axis of said tubular body of the stator above said head seal means and string seal means, said pipe connection means and the rest of said apparatus lying within the cylindrical geometrical envelope centered on the axis of said bearing means which envelope lies just outside of the outer periphery of said flange, said bearing means including inner and outer races with rotatable means therebetween, said bearing support means on the stator comprising a ring and upper and lower flanges connected to the ring and extending inwardly therefrom and forming therewith a seat receiving said outer race of the bearing means, said lower flange being connected to said tubular body and extending therefrom out over said pipe connection means, the connection of said ring to one of said flanges being releasable, said bearing support means on said rotor comprising upper and lower annular plates extending radially from said seal tube over and beyond said pipe connection means, said plates being releasably secured together and forming therebetween at their outer peripheries an annular groove receivng said inner race of said bearing means, said upper plate being releasably secured to said seal tube.

15. Apparatus according to claim 14, said plates being secured together by screws removable through the top plate, said lower flange being threaded on its outer periphery and said ring being threaded on its inner periphery and screwed onto said lower flange.

16. Apparatus according to claim 14, said top plate having a rim overlying said upper flange preventing the latter from being unscrewed independently of motion of the top plate.

17. Apparatus according to claim 14, said bearing means further comprising means to seal said bearing means against entrance of dirt into the volume between said races and to retain lubricant in said volume about said rotatable members, and lubricant reservoir means formed by said plates and communicating with said volume, said seal means comprising upper and lower smooth annular surface means respectively at the upper and lower faces of said outer race and upper and lower elastomer seal rings disposed at the upper and lower faces of said inner race held in sealing engagement therewith by said plates, said upper and lower seal rings each having an annular flexible lip extending radially outward therefrom into sliding sealing engagement with the respective one of said upper and lower smooth annular surface means, each of said smooth annular surface means comprising a washer disposed adjacent to the respective one of said upper and lower faces of said outer race and held in sealing engagement therewith by said upper and lower flanges.

18. Drilling apparatus comprising:

a stator including a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator, head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said bearing means comprising double acting antifriction axial thrust bearing means concentrated adjacent a single plane transverse to the axis of said tubular body of the stator above said head seal means and string seal means, said pipe connection means and the rest of said apparatus lying within the cylindrical geometrical envelope centered on the axis of said bearing means which envelope lies just outside of the outer periphery of said flange, said bearing means including inner and outer races with rotatable means therebetween, said bearing support means on said rotor comprising upper and lower annular plates extending radially from said seal tube over and beyond said pipe connection means, said plates being releasably secured together and forming therebetween at their outer peripheries an annular groove receiving said inner race of said bearing means, said upper plate being releasably secured to said seal tube.

19. Apparatus according to claim 18, said upper plate having a neck upstanding from its inner periphery, said neck and said tubular body of the seal tube having adjacent flanges extending radially outwardly therefrom, said upper plate being releasably secured to said seal tube as aforesaid by connection means releasably connecting said adjacent flanges.

20. Apparatus according to claim 19, said connection means comprising hinged crabs releasably engaging said adjacent flanges, said upper plate having a well between its outer periphery and said neck, said well being adapted to receive said crabs when released.

21. Apparatus according to claim 19, said seal tube having an upwardly flaring tapered shoulder on its outer periphery, said lower plate having an upwardly flaring tapered seat on its inner periphery adapted to receive said shoulder, said adjacent flanges being spaced apart, said connection means urging said adjacent flanges toward each other and urging said shoulder and seat toward each other.

22. Apparatus according to claim 21, said adjacent flanges on said seal tube and neck having an upper downwardly flaring surface and a lower upwardly flaring surface respectively, said connection means comprising hinged crab means having tapered inner surfaces adapted to engage said flaring surfaces of said adjacent flanges and press said adjacent flanges together.

23. Apparatus according to claim 18, said upper and lower plates having an annular reservoir for lubricant formed therebetween communicating with said annular groove in which said inner race is received, said inner race having port means therein communicating said reservoir with the volume between said races wherein are disposed said rotatable members.

24. Apparatus according to claim 23, said upper plate having port means extending from the upper face thereof to said reservoir for injection of lubricant and having threaded aperture means in the upper face thereof adapted to receive lifting eyes.

25. Apparatus according to claim 23, said bearing means further comprising seal means to seal between said inner and outer races above and below said rotatable members to exclude dirt from said members and retain lubricant thereabout, and means to seal between said plates radially inwardly of said reservoir to block lubricant flow from said reservoir towards the axis of said bearing means.

26. Apparatus according to claim 18, said bearing means further comprising means to seal said bearing means against entrance of dirt into the volume between said races and to retain lubricant in said volume about said rotatable members, and lubricant reservoir means formed by said plates and communicating with said volume.

27. Apparatus according to claim 26, said seal means comprising upper and lower smooth annular surface means respectively at the upper and lower faces of said outer race and upper and lower elastomer seal rings disposed at the upper and lower faces of said inner race held in sealing engagement therewith by said plates, said upper and lower seal rings each having an annular flexible lip extending radially outward therefrom into sliding sealing engagement with the respective one of said upper and lower smooth annular surface means.

28. Drilling apparatus comprising:

a stator including a well head having a tubular body adapted for connection at its lower end to other drilling apparatus such as a blowout preventer and having at its upper end a box, and a rotor including a seal tube having a tubular body provided with a pin rotatably disposed in said box and having a non-circular socket, said rotor further including drive bushing means having a non-circular outer portion non-rotatably received in said socket and axially upwardly supported by said seal tube and having an opening adapted to receive a drive tube such as a kelly rotated by a rotary table or the top joint of a drill string rotated by a power swivel, bearing means, carried by a bearing support means on said stator and rotor, rotatably supporting said rotor by said stator, head seal means rotatably sealing between said pin and box, string seal means carried by said seal tube adapted to seal between said seal tube and such drive tube, said well head having a flow port in its side wall, and pipe connection means for making connection of a flow pipe to said well head in communication with said port, said apparatus being characterized by:

said bearing means including inner and outer races with rotatable means therebetween, said bearing support means on the stator comprising a ring and upper and lower flanges connected to the ring and extending inwardly therefrom and forming therewith a seat receiving said outer race of the bearing means, said lower flange being connected to said tubular body of said well head and extending therefrom out over said pipe connection means, the connection of said ring to one of said flanges being releasable, said bearing support means on said rotor comprising upper and lower annular plates extending radially from said tubular body of the seal tube over and beyond said pipe connection means, said plates being releasably secured together and forming therebetween at their outer peripheries an annular groove receiving said inner race of said bearing means, said upper plate being releasably secured to said tubular body of the rotor.

29. Apparatus accoring to claim 28, said plates being secured together by screws removable through said upper plate;

said lower flange being threaded on its outer periphery and said ring being threaded on its inner periphery and screwed onto said lower flange.

30. Apparatus according to claim 28, said upper plate having a rim overlying said upper flange preventing the latter from being unscrewed independently of motion of said upper plate.

31. Drilling apparatus comprising:

a stator including a well head having a tubular body adapted for connection at its lower end to other drilling apparatus such as a blowout preventer and having at its upper end a box, and a rotor including a seal tube having a tubular body provided with a pin rotatably disposed in said box and having a non-circular socket, said rotor further including drive bushing means having a non-circular outer portion non-rotatably received in said socket and axially upwardly supported by said seal tube and having an opening adapted to receive a drive tube such as a kelly rotated by a rotary table or the top joint of a drill string rotated by a power swivel, bearing means, carried by bearing support means on said stator and rotor, rotatably supporting said rotor by said stator, head seal means rotatably sealing between said pin and box, string seal means carried by said seal tube adapted to seal between said seal tube and such drive tube, said well head having a flow port in its side wall, and pipe connection means for making connection of a flow pipe to said well head in communication with said port, said apparatus being characterized by:

said bearing means including inner and outer races with rotatable means therebetween, said bearing support means on said rotor comprising upper and lower annular plates extending radially from said tubular body of the seal tube over and beyond said pipe connection means, said plates being releasably secured together and forming therebetween at their outer peripheries an annular groove receiving said inner race of said bearing means, said upper plate being releasably secured to said tubular body of the rotor.

32. Apparatus according to claim 31, said upper plate having a neck upstanding from its inner periphery, said neck and said tubular body of the seal tube having adjacent flanges extending radially outwardly therefrom, said upper plate being releasably secured to said tubular body of the seal tube as aforesaid by connection means releasably connecting said adjacent flanges.

33. Apparatus according to claim 32, said connection means comprising hinged crabs releasably engaging said adjacent flanges, said upper plate having a well between its outer periphery and said neck, said well being adapted to receive said crabs when released.

34. Apparatus according to claim 32, said tubular body having an upwardly flaring tapered shoulder on its outer periphery, said lower plate having an upwardly flaring tapered seat on its inner periphery adapted to receive said shoulder, said adjacent flanges being spaced apart, said connection means urging said adjacent flanges toward each other and urging said shoulder and seat toward each other.

35. Apparatus according to claim 34, said adjacent flanges on said tubular body and neck having an upper downwardly flaring surface and a lower upwardly flaring surface respectively, said connection means comprising hinged crab means having tapered inner surfaces adapted to engage said flaring surfaces of said adjacent flanges and press said adjacent flanges together.

36. Apparatus according to claim 31, said upper and lower plates having an annular reservoir for lubricant formed therebetween communicating with said annular groove in which said inner race is received, said inner race having port means therein communicating said reservoir with the volume between said races wherein are disposed said rotatable members.

37. Apparatus according to claim 36, said upper plate having port means extending from the upper face thereof to said reservoir for injection of lubricant and having threaded aperture means in the upper face thereof adapted to receive lifting eyes.

38. Apparatus according to calim 36, said bearing means further comprising seal means to seal between said inner and outer races above and below said rotatable members to exclude dirt from said members and retain lubricant thereabout, and means to seal between said plates radially inwardly of said reservoir to block lubricant flow from said reservoir towards the axis of said bearing means.

39. Apparatus according to claim 31, said bearing means further comprising means to seal said bearing means against entrance of dirt into the volume between said races and to retain lubricant in said volume about said rotatable members, and lubricant reservoir means formed by said plates and communicating with said volume.

40. Apparatus according to claim 39, said seal means comprising upper and lower smooth annular surface means respectively at the upper and lower faces of said outer race and upper and lower elastomer sealings disposed at the upper and lower faces of said inner race held in sealing engagement therewith by said plates, said upper and lower seal rings each having an annular flexible lip extending radially outward therefrom into sliding sealing engagement with the respective one of said upper and lower smooth annular surface means.

41. Apparatus according to claim 31, said bearing support means on the stator comprising a ring and upper and lower flanges connected to the ring and extending inwardly therefrom and forming therewith a seat receiving said outer race of the bearing means, said lower flange being connected to said tubular body or the well head, the connection of said ring to one of said flanges being releasable, said bearing means further comprising means to seal said bearing means against entrance of dirt into the volume between said races and to retain lubricant in said volume about said rotatable members, and lubricant reservoir means formed by said plates and communicating with said volume, said means comprising upper and lower smooth annular surface means respectively at the upper and lower faces of said outer race and upper and lower elastomer sealings disposed at the upper and lower faces of said inner race held in sealing engagement therewith by said plates, and upper and lower seal rings each having an annular flexible lip extending radially outward therefrom into sliding sealing engagement with the respective one of said upper an lower smooth annular surface means, each of said smooth annular surface means comprising a washer disposed adjacent to the respective one of said upper and lower faces of said outer race and held in sealing engagement therewith by said upper and lower flanges.

42. Drilling apparatus comprising:

a stator including a well head having a tubular body with a radial falnge at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator;

head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seat tube and such drive tube below said head seal, said string seal means being below such drive bushing means and below said bearing means and extending downwardly into said tubular body to a level adjacent said side flow port, said pipe connection means comprising a seal face about said port on the outer periphery of said tubular body of the well head adapted for making a sealing connection with a pipe flange and threaded securement means in said side of the tubular body of the well head disposed about said seal face for engaging complimentary threaded securement means to hold such pipe flange to said seal face, said pipe connection means and the rest of said apparatus lying within the cylindrical geometrical envelope centered on the axis of said bearing means which envelope lies just outside of the outer periphery of said flange.

43.

said bearing means including inner and outer races with rotatable means therebetween, said bearing support means on the stator comprising a ring and upper and lower flanges connected to the ring and extending inwardly therefrom and forming therewith a seat receiving said outer race of the bearing means, said lower flange being connected to said tubular body and extending therefrom out over said pipe connection means, the connection of said ring to one of said flanges being releasable.

44. Apparatus according to claim 43, said inner race comprising a single ring, said outer race including separable upper and lower rings, said upper and lower flanges holding said upper and lower rings together.

45. Drilling apparatus comprising:

a stator including a well head having a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator;

head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said pipe connection means comprising a seal face about said port on the outer periphery of said tubular body of the well head adapted for making a sealing connection with a pipe flange and threaded securement means in said side of the tubular body of the well head disposed about said seal face for engaging complimentary threaded securement means to hold such pipe flange to said seal face, said pipe connection means and the rest of said apparatus lying within the cylindrical geometrical envelope centered on the axis of said bearing means which envelope lies just outside of the outer periphery of said flange, said head seal means including a liner sleeve seated on an annular shoulder in said tubular body of said stator and releasably held in place thereon, and packing means about said rotor rotationally slidably engaging said sleeve and making a rotating seal therewith, said packing means being releasably positioned on and turning with said rotor.

46. Apparatus according to claim 45, said head seal means further including port means in said tubular body communicating with an annular passage between said liner and the last said body, said liner having an annular groove on its inner face, and port means in the liner communicating said annular groove in the liner with said annular passage, whereby lubricant can be introduced to said packing means.

47. Apparatus according to claim 46, said packing means including a stack of rings, one of said rings being a metal ring having an annular groove adjacent to said annular groove of the liner, other ones of said rings above and below said metal ring being downwardly facing double lip flexible seal rings.

48. Drilling apparatus comprising:

a stator including a well head having a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel;

said rotor further including second bearing support means;

bearing means, carried by said first and second bearing support means, rotatably supporting said rotor by said stator;

head seal means rotatably sealing between an outwardly facing surface of said rotor and an inwardly facing surface of the stator, said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said head seal means including annular seal means disposed about the outer periphery of said rotor against an external shoulder thereabout, said string seal means comprising tubular seal means having an upper portion disposed about the inner periphery of said rotor against an internal shoulder thereof, said head and string seal means further including retainer ring means releasably secured to the lower end of said rotor holding said annular and tubular seal means to said rotor, said head seal means and string seal means extending axially in opposite directions from said retainer ring, said tubular seal means extending downwardly from said retainer ring means and said head seal means extending upwardly therefrom.

49. Drilling apparatus comprising:

a stator including a well head having a tubular body with a radial flange at the lower end of the body adapted for connection to other drilling apparatus such as a blowout preventer, said stator having above said flange first bearing support means, said body having above said flange and below said first bearing support means a side flow port through the side wall of said tubular body with pipe connection means about said side flow port for connecting a flow pipe to said stator in communication with said side flow port;

a rotor including a seal tube rotatably disposed in said stator, said tube having a non-circular socket, said rotor further including drive bushing means having a non-circular outer portion non-rotatably received in said socket and axially upwardly supported by said seal tube, said drive bushing means having an opening adapted to receive a drive tube such as a kelly rotated by a rotary table or the top joint of a drill string rotated by a power swivel, said rotor further including second bearing support means;

bearing means, carried by said first and second bearing support means, rotatably supporting said rotor by said stator;

said head seal means being below said drive bushing means and below said bearing means and above said side flow port, and string seal means carried by said seal tube adapted to seal between said seal tube and such drive tube below said head seal, said string seal means being below such drive bushing means and below said bearing means and extending downwardly into said tubular body to a level adjacent said side flow port, said string seal means comprising a tubular elastomeric seal means having a metal ring bonded to the upper end thereof, said ring having an outer peripheral groove thereabout, and a split retention collar disposed in said groove and releasably secured to the lower end of said rotor.

50. Apparatus according to claim 49, said metal ring including an upper annular portion wherein is disposed said groove and a plurality of azimuthally spaced fingers extending down from said upper portion into the elastomer of said elastomer seal means and adapted to flex therewith.

* * * * *

UNITED STATES PATENT AND TRADEMARK OFFICE

CERTIFICATE OF CORRECTION

PATENT NO. : 4,281,724

DATED : Aug. 4, 1981

INVENTOR(S) : William R. Garrett

It is certified that error appears in the above—identified patent and that said Letters Patent is hereby corrected as shown below:

Column 4, line 43: before "single" insert -race of the-.

Column 6, line 48: change "their" to -the-.

Column 6, line 48: change "the" to -their-.

Column 9, line 20: delete "flaring".

Column 22, line 12: change "falnge" to -flange-.

Column 22, line 63: after "43." insert -Apparatus according to claim 42-.

Signed and Sealed this

Thirtieth Day of March 1982

[SEAL]

Attest:

GERALD J. MOSSINGHOFF

Attesting Officer

Commissioner of Patents and Trademarks